US006566938B2

(12) United States Patent
Akaogi

(10) Patent No.: US 6,566,938 B2
(45) Date of Patent: May 20, 2003

(54) SYSTEM FOR A CONSTANT CURRENT SOURCE

(75) Inventor: Takao Akaogi, Cupertino, CA (US)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/916,972

(22) Filed: Jul. 27, 2001

(65) Prior Publication Data

US 2003/0020532 A1 Jan. 30, 2003

(51) Int. Cl.[7] ..... G05F 1/10
(52) U.S. Cl. ..... 327/538; 327/543
(58) Field of Search ..... 327/538–543, 327/545

(56) References Cited

U.S. PATENT DOCUMENTS 5,568,084 A * 10/1996 McClure et al. ..... 327/538
5,942,809 A * 8/1999 Hashimoto ..... 327/540
6,348,833 B1 * 2/2002 Tsujimoto et al. ..... 327/540

* cited by examiner

*Primary Examiner*—Kenneth B. Wells
(74) *Attorney, Agent, or Firm*—Sheppard Mullin Richter & Hampton LLP

(57) ABSTRACT

A system for a constant current source circuit utilizing CMOS technology. The system includes a constant current source circuit that includes a bias circuit that outputs a bias signal and a switch circuit that has a switch input coupled to receive the bias signal, a switch output, and a switch control that is coupled to receive an input signal. The current source circuit also includes an output circuit that has a first input coupled to the switch output and a second input coupled to the input signal. The output circuit provides an output signal that has constant current.

7 Claims, 2 Drawing Sheets

SYSTEM FOR A CONSTANT CURRENT SOURCE

FIELD OF THE INVENTION

The present invention relates to current sources, and more particularly, to a constant current source using CMOS technology.

BACKGROUND OF THE INVENTION

Typically, the use of NMOS components made it relatively easy to realize a constant current source. FIG. 1 shows an NMOS transistor 100 configured as a typical constant current source. The gate terminal 102 is connected to the source terminal 104 so that the gate to source voltage (Vgs) equals zero. Since the transistor 100 has a negative voltage threshold (Vt), constant drain current is available. This typical constant current source has been widely used to make an RC time constant that is independent of the power supply (Vcc).

FIG. 2 shows an RC circuit 200 that uses the typical constant current source circuit of FIG. 1. The circuit 200 includes NMOS transistor 202 that forms the constant current source and transistor 204 that receives a control input 206. The circuit 200 also includes a timing capacitor 208 couple to output 210. During operation, the constant current source 202 provides constant current to charge the timing capacitor 208 and thereby form a consistent output signal.

FIG. 3 shows graph 300 of the output of the RC circuit 200 of FIG. 2 plotted against time. As indicated at 302, when the input signal is at a high level (in H), the output signal approaches zero. As indicated at 304, when the input signal is at a low level (in L), the output signal rises at a constant rate as a result of the constant current source providing constant current. For example, dv/dt at the output is a constant, since a constant current is received by the capacitor 208. Thus, the constant current source allows many useful circuits to be constructed, such as the constant current RC circuit.

However, as technology has migrated to utilizing CMOS processes and components, the negative threshold NMOS transistor has become generally unavailable. Therefore, it is desirable to have a way to obtain a constant current source utilizing CMOS technology.

SUMMARY OF THE INVENTION

The present invention includes a system for providing a constant current source utilizing CMOS technology. The system includes a CMOS circuit that replaces typical NMOS circuits to produce a constant current.

In one embodiment of the invention, a CMOS circuit that operates as a constant current source is provided. The circuit comprises a bias circuit that includes a bias output terminal. The bias circuit produces a bias signal that is output at the bias output terminal. The circuit also includes a switch circuit having a switch input terminal coupled to the bias output terminal to receive the bias signal. The switch circuit also includes a switch output terminal and a switch control terminal that is coupled to receive an input signal, and wherein the bias signal is switched to the switch output terminal to form a switched bias signal in response to the input signal. The circuit also includes an output circuit having a first input terminal coupled to the switch output terminal to receive the switched bias signal, a second input terminal coupled to receive the input signal and an output terminal. The output circuit operates to produce an output signal that has constant current at the output terminal.

In one embodiment of the invention, a method for generating constant current from a CMOS circuit is provided. The method comprises the steps of generating a bias signal, switching the bias signal in response to an input signal, wherein a switched bias signal is produced, and receiving the input signal and the switched bias signal to produced an output signal that provides constant current.

BRIEF DESCRIPTION OF THE DRAWINGS

The forgoing aspects and the attendant advantages of this invention will become more readily apparent by reference to the following detailed description when taken in conjunction with the accompanying drawings wherein.

DETAILED DESCRIPTION OF THE INVENTION

The present invention includes a CMOS constant current source circuit. One or more embodiments included in the present invention will now be described, however, it is possible to make changes and variations to the described embodiments without deviating from the scope of the present invention.

Figure 1:
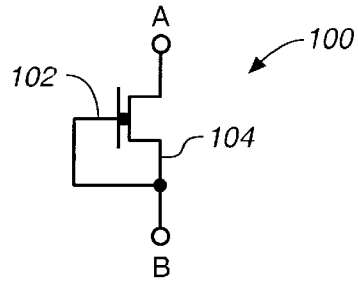
FIG. 1 (PRIOR ART)
FIG. 1 shows an NMOS transistor configured as a typical constant current source.
Figure 2:
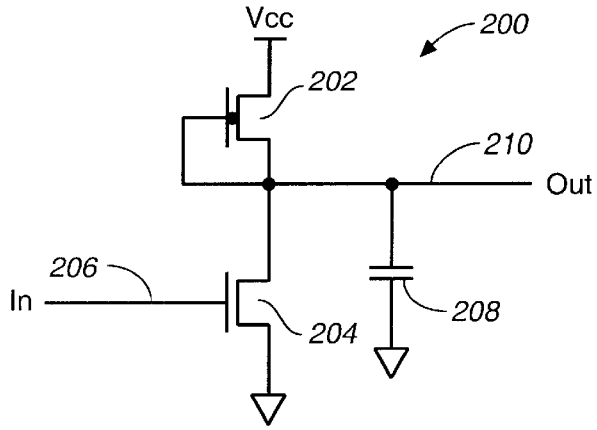
FIG. 2 (PRIOR ART)
FIG. 2 shows an RC circuit that uses the typical constant current source circuit of FIG. 1.
Figure 3:
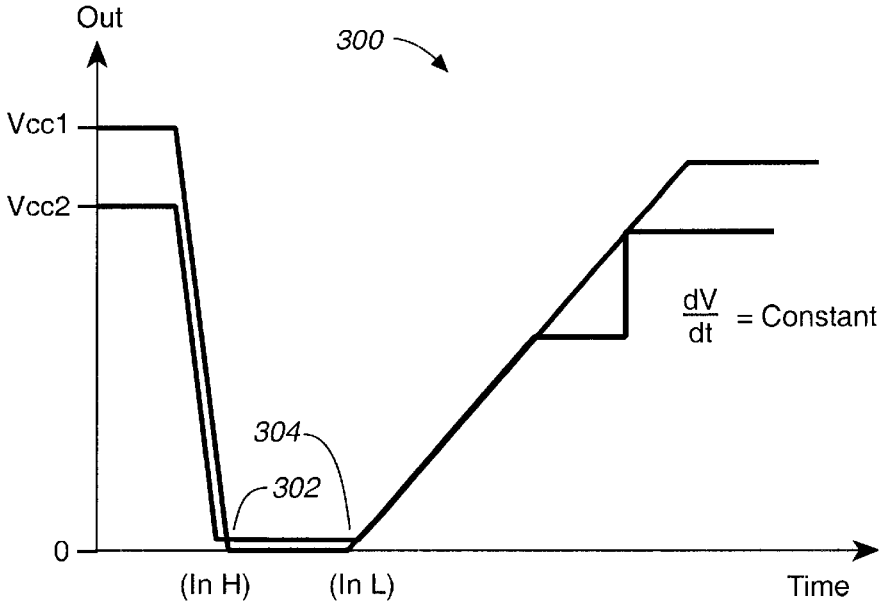
FIG. 3 (PRIOR ART)
FIG. 3 shows graph of the output of the RC circuit of FIG. 2 plotted against time.
Figure 4:
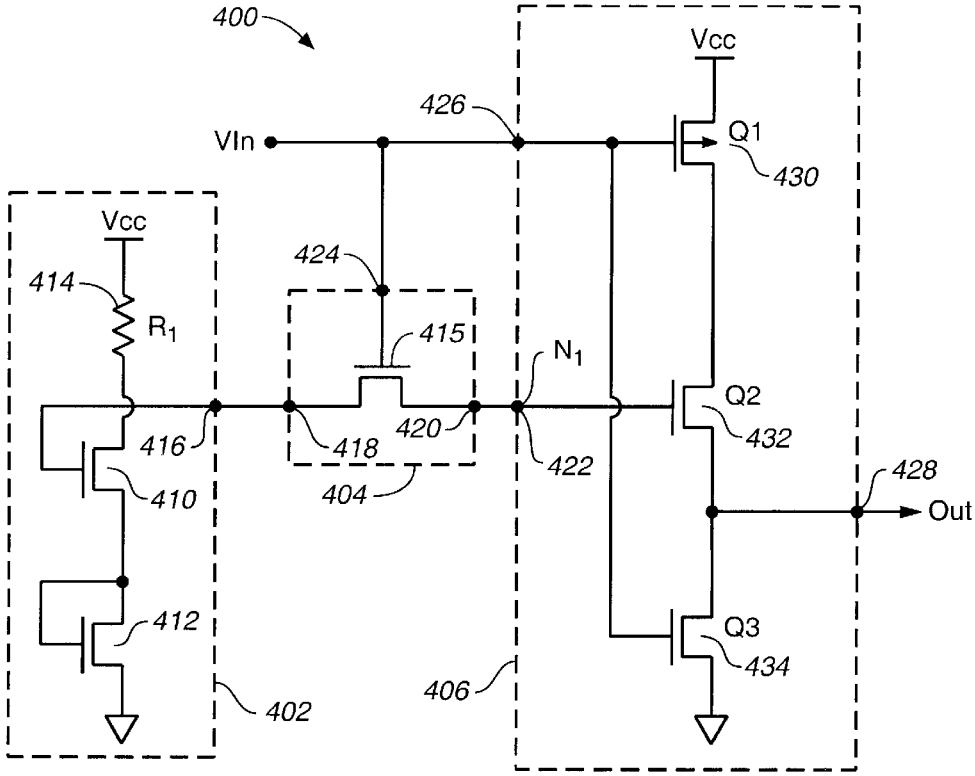
FIG. 4 shows one embodiment of a CMOS circuit that operates as a constant current source in accordance with the present invention.

FIG. 4 shows one embodiment of a CMOS circuit 400 that operates as a constant current source in accordance with the present invention. The circuit 400 includes a bias circuit 402, a switch circuit 404 and an output circuit 406.

The bias circuit 402 includes a bias output terminal 416. In one embodiment, the bias circuit is formed by N channel transistor 410, N channel transistor 412 and resistor 414. The bias circuit 402 sets a bias voltage level that is output at the bias output terminal 416.

The switch circuit 404 includes a switch input terminal 418, a switch output terminal 420 and a switch control terminal 424. In one embodiment, the switch circuit 404 is formed by N channel transistor 415 that has a drain terminal coupled to the switch input terminal 418, a source terminal coupled to the switch output terminal 420 and a gate terminal coupled to the switch control terminal 424; The switch input terminal 418 is coupled to the bias output terminal 416. The switch control terminal is coupled to an input signal (Vin) and the switch output terminal 420 is coupled to a first input terminal 422 of the output section 406.

The output circuit 406 includes the first input terminal 422 (also referred to as node N1), a second input terminal 426 and an output terminal 428. In one embodiment the output circuit 406 includes P channel transistor 430, N channel transistor 432, and N channel transistor 434 that are coupled together to produce an output signal (out) that provides a constant current at the output terminal 428. The first input terminal 422 (N1) is coupled to the switch output terminal 420. The second input terminal 426 is coupled to the input signal Vin.

During operation of the circuit 400, when the input signal Vin is at a high level, the output signal (out) at output terminal 428 is low and node N1 has a voltage level that is set to 2*Vtn, where Vtn is equivalent to the threshold voltage (Vt) of an N-channel transistor. When the Vin signal goes to a low level, node N1 is isolated while the output signal at terminal 428 starts going high. As the output voltage goes high, node N1 level is coupled high due to the channel capacitance of transistor 432. As a result, the voltage Vn1 on node N1 is described by;

$$Vn1=2*Vtn+Vout$$

Thus, the gate to source voltage of transistor 432 is kept less than or equal to Vtn. Assuming the transistor 432 is operating in saturation mode, constant current is available at the output terminal 428.

Figure 5:
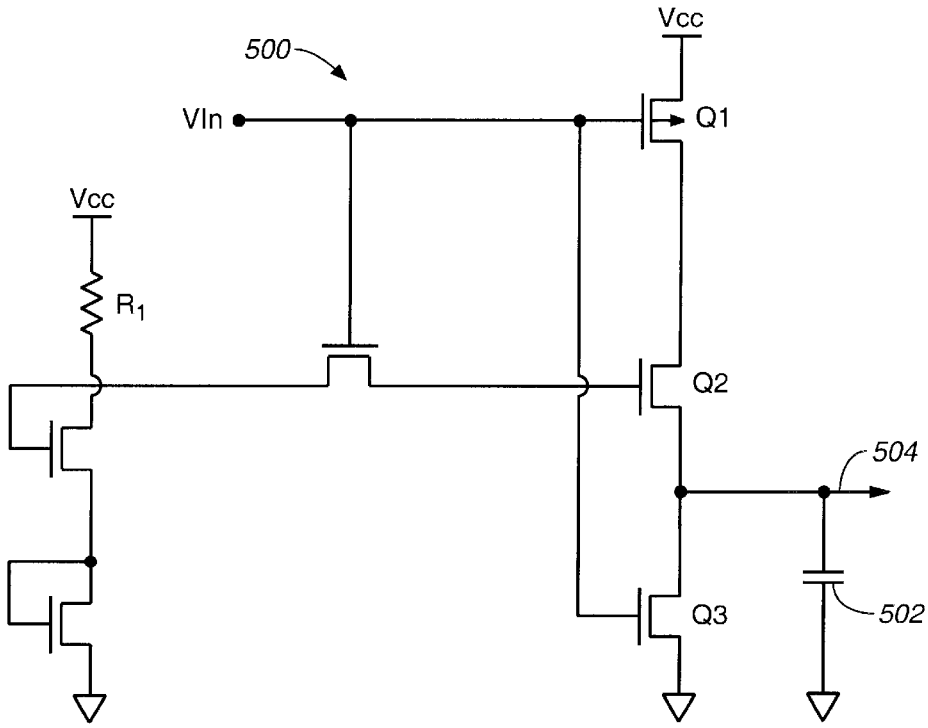
FIG. 5 shows an RC circuit that utilizes one embodiment of a CMOS constant current source constructed in accordance with the present invention.

FIG. 5 shows an RC circuit 500 that utilizes one embodiment of a CMOS constant current source constructed in accordance with the present invention. The circuit 200 also includes a timing capacitor 502 couple to output 504. During operation, the constant current source provides constant current to charge the timing capacitor and thereby form a constant dv/dt across capacitor 502.

The present invention includes a constant current source that utilizes CMOS technology. The embodiments described above are illustrative of the present invention and are not intended to limit the scope of the invention to the particular embodiments described. Accordingly, while one or more embodiments of the invention have been illustrated and described, it will be appreciated that various changes can be made therein without departing from the spirit or essential characteristics thereof. Accordingly, the disclosures and descriptions herein are intended to be illustrative, but not limiting, of the scope of the invention which is set forth in the following claims.

What is claimed is:

1. A CMOS circuit that operates as a constant current source, the circuit comprising:

a switch transistor outputting a predetermined voltage when a switch control signal (Vin) is at a first voltage level; and an output circuit including a first transistor, a second transistor and an output node that is between the first and second transistors the first transistor having a drain terminal receiving a first reference voltage (VCC) when the switch control signal (Vin) is at a second voltage level, and a gate terminal coupled to the switch transistor for receiving the predetermine voltage, the second transistor having a source terminal coupled to a second reference voltage (VSS), and a gate terminal receiving the switch control signal, wherein the second transistor sets the output node at the second reference voltage (VSS) when the switch control signal is at the first voltage level, while the first transistor produces the constant current at the output node when the switch control signal goes from the first voltage level to the second voltage level as a result of the gate terminal of the first transistor being coupled high due to the channel capacitance of the first transistor and the gate to source voltage of the first transistor being kept at a constant voltage.

2. The circuit of claim 1, further comprising a third transistor having a source terminal coupled to the first reference voltage (VCC), a gate terminal receiving the switch control signal, and drain terminal coupled to the drain terminal of the first transistor, wherein the third transistor outputs the first reference voltage (VCC) to the drain terminal of the first transistor when the switch control signal goes from the first voltage level to the second voltage level.

3. The circuit of claim 2, wherein the first transistor and the second transistor are NMOS transistor, and the third transistor is a PMOS transistor.

4. The circuit of claim 1, further comprising a bias circuit including a bias output terminal coupled to the switch transistor and at least one transistor, the source of the transistor coupled to ground, the drain of the transistor coupled to the bias output terminal, wherein the bias circuit generates the predetermined voltage being dependent on a threshold voltage of the transistor.

5. The circuit of claim 4, wherein the gate to source voltage of the first transistor is equal to the predetermined voltage.

6. A method for generating constant current from a CMOS circuit, the method comprising steps of:

outputting a predetermined voltage when a switch control signal (Vin) is at a first voltage level;

receiving a first reference voltage (VCC) when the switch control signal (Vin) is at a second voltage level, wherein the first reference voltage is received at an output circuit that includes a first transistor, a second transistor, and an output node that is between the first and second transistors, and wherein the first transistor has a drain terminal;

receiving the predetermine voltage at a gate terminal of the first transistor that is coupled to the switch transistor;

receiving the switch control signal at the second transistor having a source terminal coupled to a second reference voltage (VSS), and a gate terminal, wherein the second transistor sets the output node at the second reference voltage (VSS) when the switch control signal is at the first voltage level, while the first transistor produces the constant current at the output node when the switch control signal goes from the first voltage level to the second voltage level as a result of the gate terminal of the first transistor being coupled high due to the channel capacitance of the first transistor and the gate to source voltage of the first transistor being kept at a constant voltage.

7. The method of claim 6, wherein the CMOS circuit includes a bias circuit, and the method further comprises steps of:

generating a bias signal at the bias circuit; and switching the bias signal in response to the switch control signal to produce the predetermined voltage.

* * * * *